US008009858B2

(12) United States Patent
Cobb

(10) Patent No.: US 8,009,858 B2
(45) Date of Patent: Aug. 30, 2011

(54) LOUDSPEAKER

(76) Inventor: Jason Myles Cobb, Odessa, TX (US)

( * ) Notice: Subject to any disclaimer, the term of this patent is extended or adjusted under 35 U.S.C. 154(b) by 944 days.

(21) Appl. No.: 11/987,362

(22) Filed: Nov. 28, 2007

(65) Prior Publication Data

US 2009/0136078 A1 May 28, 2009

(51) Int. Cl.

| | |
|---|---|
| ***H04R 1/02*** | (2006.01) |
| ***H04R 7/00*** | (2006.01) |
| ***H04R 25/00*** | (2006.01) |
| ***H04R 31/00*** | (2006.01) |

(52) U.S. Cl. ..... 381/423; 381/182; 381/184; 381/186; 381/396; 381/424; 381/432; 181/163; 29/594

(58) Field of Classification Search ..... 29/594; 181/163; 381/182, 184, 186, 396, 423, 424, 381/432

See application file for complete search history.

(56) References Cited

U.S. PATENT DOCUMENTS

| | | | | | |
|---|---|---|---|---|---|
| 1,844,787 | A * | 2/1932 | Newill | 381/432 |
| 2,231,479 | A * | 2/1941 | Perry | 381/186 |
| 2,496,589 | A * | 2/1950 | Firth | 381/186 |
| 3,116,377 | A * | 12/1963 | Todt | 381/407 |
| 3,213,209 | A * | 10/1965 | Doelitzsch | 381/186 |
| 4,239,943 | A * | 12/1980 | Czerwinski | 381/404 |
| 4,477,699 | A * | 10/1984 | Wada et al. | 381/184 |
| 4,595,801 | A * | 6/1986 | Coffin | 381/424 |
| 4,965,839 | A * | 10/1990 | Elieli | 381/339 |
| 5,295,194 | A * | 3/1994 | Christensen | 381/190 |
| 5,548,657 | A * | 8/1996 | Fincham | 381/182 |
| 6,111,969 | A * | 8/2000 | Babb | 381/396 |
| 6,212,284 | B1 * | 4/2001 | Puls | 381/345 |
| 6,466,676 | B2 * | 10/2002 | Coffin | 381/186 |
| 6,963,650 | B2 * | 11/2005 | Combest | 381/182 |
| 7,809,148 | B2 * | 10/2010 | Cobb | 381/186 |
| 7,848,533 | B2 * | 12/2010 | Cobb | 381/186 |
| 2002/0071588 | A1 * | 6/2002 | Proni | 381/403 |
| 2003/0185415 | A1 * | 10/2003 | Funahashi et al. | 381/398 |
| 2005/0008188 | A1 * | 1/2005 | Harris | 381/404 |
| 2005/0244031 | A1 * | 11/2005 | Nevill | 381/407 |

* cited by examiner

*Primary Examiner* — Elvin G Enad
*Assistant Examiner* — Christina Russell
(74) *Attorney, Agent, or Firm* — Stephen R. Greiner

(57) ABSTRACT

A loudspeaker including a frame and a toroidal magnet that is affixed to the rear of the frame. The toroidal magnet has a central passageway that opens into the frame. A cap is affixed to the rear of the magnet and closes the central passageway. A guide rod is affixed to the cap and projects forwardly from the cap into the central passageway. A tubular former is slidably positioned upon the guide rod. A voice coil is wound about, and is affixed to, the tubular former. A driver plate is affixed to the front of the tubular former. A resilient surround connects the periphery of the driver plate to the front of the frame. A suspension assembly resiliently connects the tubular former to the frame and has a pair of conical diaphragms that are secured together so as to form a bellows. A spider connects the bellows to the frame and another spider connects the bellows to the tubular former.

3 Claims, 2 Drawing Sheets

LOUDSPEAKER

FIELD OF THE INVENTION

The present invention relates generally to electrical audio signal processing systems and devices and, more particularly, to electro-acoustic audio transducers having plural diaphragms.

BACKGROUND OF THE INVENTION

A conventional loudspeaker has a cone that is vibrated over a range of frequencies to generate audible sounds. Typically, a corrugated device called a "spider" is secured to the periphery of the cone to maintain the cone's position before, during, and after, sound-producing vibrations are induced. The spider permits the cone to move forwardly and rearwardly from its resting position with the full range of motion being known as "peak-to-peak excursion." As the peak-to-peak excursion of a cone increases, so does its ability to produce louder sounds, especially at lower frequencies.

Peak-to-peak excursion of a loudspeaker cone is often made larger by increasing the diameter of the spider attached to the cone and by increasing the diameter of the cone. Unfortunately, the small cabinets or other enclosures that are used to contain a loudspeaker place limits on the sizes of cones and spiders. Thus, the sound produced by many loudspeakers is less than satisfactory in terms of its quality and its volume.

SUMMARY OF THE INVENTION

In light of the problems associated with known loudspeakers, it is a principal object of the invention to provide a loudspeaker that features a pair of conical diaphragms, secured together so as to form a bellows, that maximize the peak-to-peak excursion of a driver plate without increasing either loudspeaker size or power requirements. Also, the conical diaphragms move air like the driver plate, effectively increasing loudspeaker output. Thus, loudspeaker sound volume limits can be increased at minimal cost in space-restricted situations.

Another object of the invention is to provide a loudspeaker of compact size that can exceed the output, in terms of volume, frequency range, and quality, of a substantially larger loudspeaker of conventional construction.

It is an object of the invention to provide improved features and arrangements thereof in a loudspeaker for the purposes described that is lightweight in construction, inexpensive to manufacture, and dependable in use.

The foregoing and other objects, features, and advantages of the present loudspeaker will become readily apparent upon further review of the following detailed description of the preferred embodiments as illustrated in the accompanying drawings.

BRIEF DESCRIPTION OF THE DRAWINGS

My invention can be more readily described with reference to the accompanying drawings, in which.

Similar reference characters denote corresponding features consistently throughout the accompanying drawings.

DETAILED DESCRIPTION OF THE LOUDSPEAKERS

Figure 1:
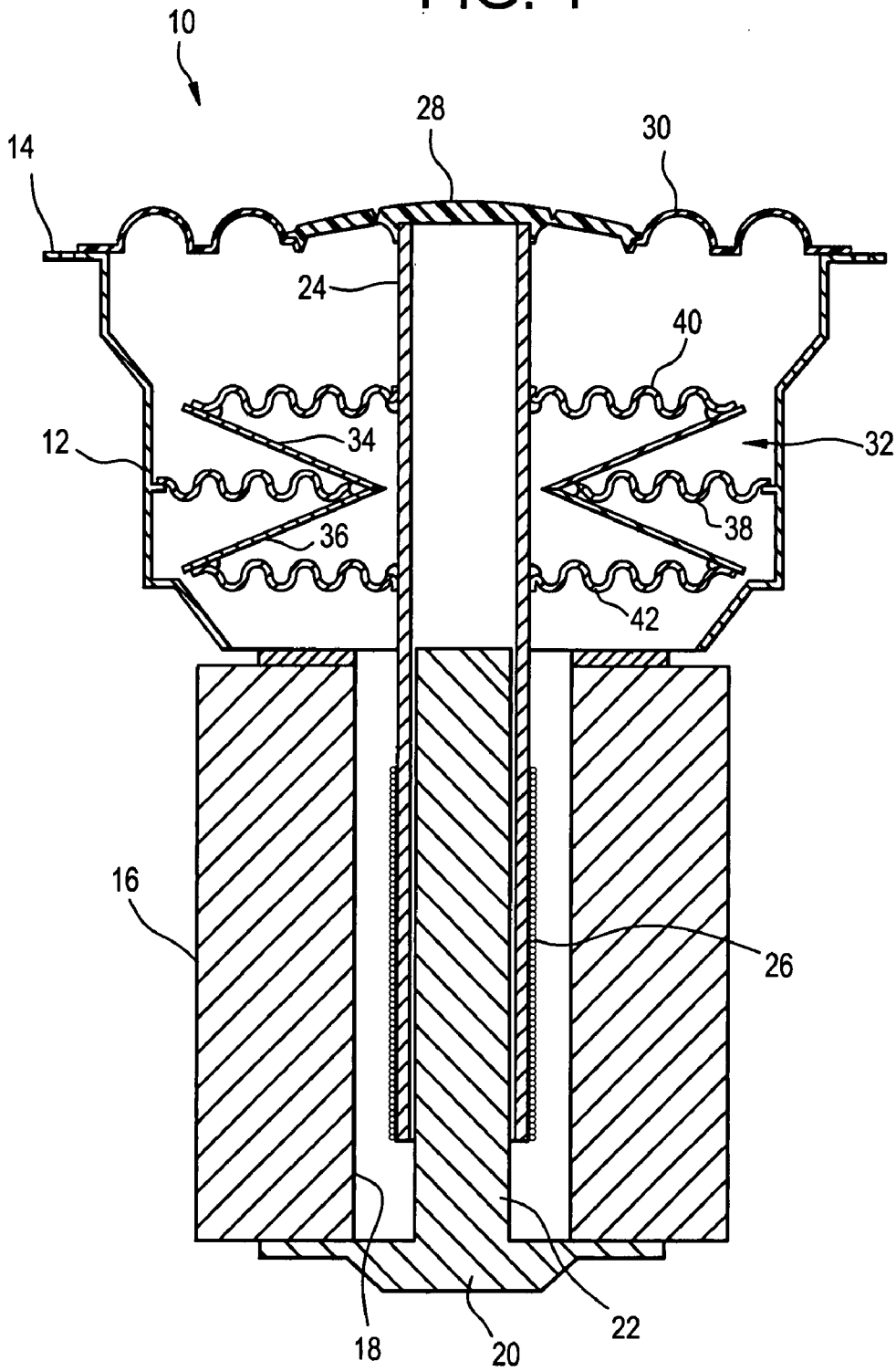
FIG. 1 is a vertical, cross-sectional view of a loudspeaker constructed in accordance with the present invention.

Referring now to the FIG. 1, a loudspeaker in accordance with the present invention is shown at 10. Loudspeaker 10 includes a conical frame 12 having an outwardly extending, peripheral, mounting flange 14 at its wide, front end and, also, having a narrow, rear end to which is affixed a toroidal magnet 16 with a central passageway 18 that opens into frame 12. A cap 20 is affixed to the rear end of magnet 16 that closes passageway 18. A guide rod 22, integrally formed with cap 20, projects forwardly from cap 20 and through passageway 18. A tubular former 24 is slidably positioned upon rod 22 in the annular space located in passageway 18 between rod 22 and magnet 16. A voice coil 26 is wound about, and is affixed to, former 24 yet is spaced away from magnet 16. A rigid, driver plate 28 is affixed to the front end of former 24 and projects radially outward therefrom. The periphery of plate 24 is affixed, by means of a resilient, ring-shaped surround 30, to flange 14. A suspension assembly 32 further secures former 24 to frame 12 and includes a pair of conical diaphragms 34 and 36 that are connected together at their respective narrow ends through which former 24 freely passes. The connected, narrow ends of diaphragms 34 and 36 are secured to frame 12 by a corrugated, medial spider 38. The wide, forward end of diaphragm 34 is secured to former 24 by a corrugated, forward spider 40. The wide, rearward end of diaphragm 36 is secured to former 24 by a corrugated, rearward spider 42. A pair of electrical leads (not shown) delivers an electrical current to voice coil 26 thereby making coil 26 into an electromagnet.

Figure 2:
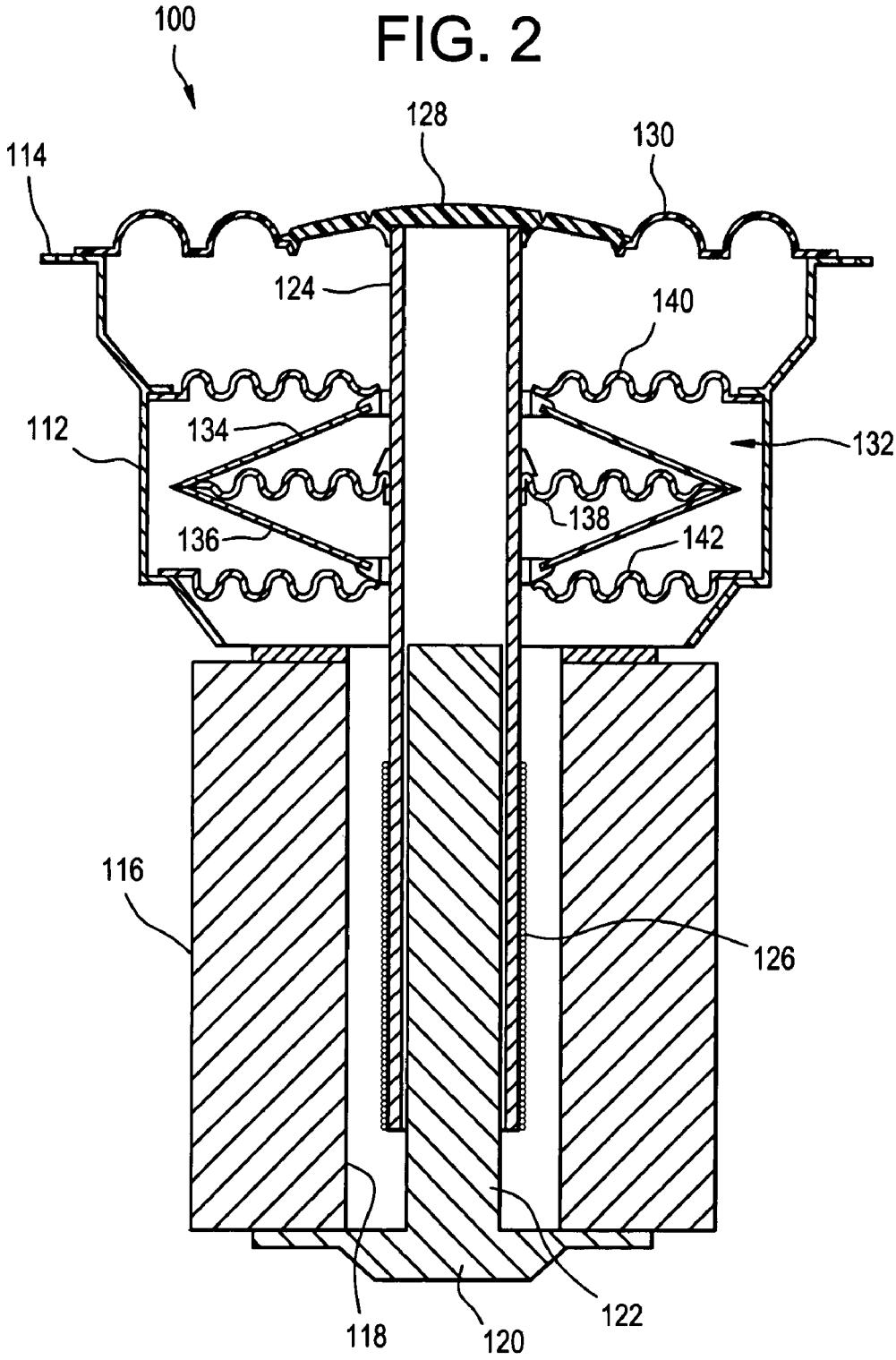
FIG. 2 is a vertical, cross-sectional view of an alternate loudspeaker constructed in accordance with the present invention.

In FIG. 2, an alternate embodiment of my loudspeaker can be seen at 100. Loudspeaker 100 includes a conical frame 112 having an outwardly extending, peripheral, mounting flange 114 at its wide, front end and, also, having a narrow, rear end to which is affixed a toroidal magnet 116 with a central passageway 118 that opens into frame 112. A cap 120 is affixed to the rear end of magnet 116 that closes passageway 118. A guide rod 122, integrally formed with cap 120, projects forwardly from cap 120 and through passageway 118. A tubular former 124 is slidably positioned upon rod 122 in the annular space located in passageway 118 between rod 122 and magnet 116. A voice coil 126 is wound about, and is affixed to, former 124 yet is spaced away from magnet 116. A rigid, driver plate 128 is affixed to the front end of former 124 and projects radially outward therefrom. The periphery of plate 128 is affixed, by means of a resilient, ring-shaped surround 130, to flange 114. A suspension assembly 132 secures former 124 to frame 112 and includes a pair of conical diaphragms 134 and 136 that are connected together at their respective wide ends positioned near frame 112. The connected, wide ends of diaphragms 134 and 136 are secured to former 124 by a corrugated, medial spider 138. The narrow, forward end of diaphragm 134, through which former 124 freely passes, is secured to frame 112 by a corrugated, forward spider 140. The narrow, rearward end of diaphragm 136, through which former 124 freely passes, is secured to frame 112 by a corrugated, rearward spider 142. A pair of electrical leads (not shown) delivers an electrical current to voice coil 126 thereby making coil 126 into an electromagnet.

The use of loudspeakers 10 and 110 is straightforward. To use loudspeaker 10, voice coil 26 is cyclically energized so as to cause former 24 to vibrate longitudinally at predetermined frequencies. Driver plate 28 and diaphragms 34 and 36, being matched in terms of their sound production characteristics, respond simultaneously to the frequencies at which former 24 vibrates. Surround 30 and spiders 38-42 serve to return former 24 to its original position when deflected by the action of coil 26. Similarly, in loudspeaker 110, voice coil 126 is cyclically energized so as to cause former 124, driver plate 128 and diaphragms 138-142, to vibrate. Surround 130 and spiders 138-142 serve to return former 124 to its original position when deflected by the action of coil 126. The result in both loudspeakers 10 and 110 is the production of audible tones (particularly those having a low frequency) of high volume.

While loudspeakers 10 and 110 have been described with a high degree of particularity, it will be appreciated by those skilled in the art that modifications can be made to them. Thus, it is to be understood that the present invention is not limited to loudspeakers 10 and 110, but encompasses any and all loudspeakers within the scope of the following claims.

I claim:

1. A loudspeaker, comprising:

a frame;

a toroidal magnet being affixed to the rear of the frame, the toroidal magnet having a central passageway that opens into the frame;

a cap being affixed to the rear of the magnet and closing the central passageway;

a guide rod being affixed to the cap and projecting forwardly from the cap into the central passageway;

a tubular former being slidably positioned upon the guide rod;

a voice coil being wound about, and being affixed to, the tubular former;

a driver plate being affixed to the front of said tubular former;

a resilient surround connecting the periphery of said driver plate to the front of said frame; and, a suspension assembly for resiliently connecting said tubular former to said frame, said assembly including:

a pair of conical diaphragms being secured together so as to form a bellows;

a first spider connecting said bellows to said frame; and, a second spider connecting said bellows to said tubular former.

2. The loudspeaker according to claim 1 wherein each of said conical diaphragms has a narrow end and a wide end and said conical diaphragms are secured together at the wide ends thereof and wherein said loudspeaker further includes:

a pair of said first spiders, each connecting said narrow end of a respective one of said conical diaphragms to said frame; and, said second spider connecting said wide ends of said conical diaphragms to said tubular former.

3. The loudspeaker according to claim 1 wherein each of said conical diaphragms has a narrow end and a wide end and said conical diaphragms are secured together at the narrow ends thereof and wherein said loudspeaker further includes:

a pair of said first spiders, each connecting said wide end of a respective one of said conical diaphragms to said tubular former; and, said second spider connecting said narrow ends of said conical diaphragms to said frame.

* * * * *